US010594077B2

(12) United States Patent
Tanaka et al.

(10) Patent No.: US 10,594,077 B2
(45) Date of Patent: Mar. 17, 2020

(54) CONNECTOR AND CONNECTOR ASSEMBLY

(71) Applicant: Molex, LLC, Lisle, IL (US)

(72) Inventors: Daiki Tanaka, Yamato (JP); Yuji Naito, Yamato (JP); Yuki Honda, Yamato (JP); Mei Naito, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/984,799

(22) Filed: May 21, 2018

(65) Prior Publication Data

US 2019/0140394 A1 May 9, 2019

Related U.S. Application Data

(60) Provisional application No. 62/517,232, filed on Jun. 9, 2017.

(30) Foreign Application Priority Data

Jun. 22, 2017 (JP) ..... 2017-122414

(51) Int. Cl.
*H01R 13/62* (2006.01)
*H01R 13/627* (2006.01)
(Continued)

(52) U.S. Cl.
CPC ..... *H01R 13/6273* (2013.01); *H01R 12/727* (2013.01); *H01R 13/631* (2013.01);
(Continued)

(58) Field of Classification Search
CPC .. H01R 13/6273; H01R 12/716; H01R 12/73; H01R 12/727; H01R 12/57; H01R 4/02; H01R 13/2464; H01R 12/7017
(Continued)

(56) References Cited

U.S. PATENT DOCUMENTS 8,794,615 B2 8/2014 Kato et al.
9,124,011 B2 * 9/2015 Miyazaki ..... H01R 12/716
(Continued)

FOREIGN PATENT DOCUMENTS

CN 103765699 A 4/2014
CN 103811886 A 5/2014
(Continued)

OTHER PUBLICATIONS

Office Action received for Korean application No. 10-2018-0056904, dated Jan. 18, 2018, 9 pages. (5 pages of English Translation and 4 pages of Official copy).

*Primary Examiner* — Jean F Duverne
(74) *Attorney, Agent, or Firm* — Molex, LLC

(57) ABSTRACT

A connector includes a connector body, terminals installed in the connector body, and lock devices fit to the connector body. The connector body includes mating guide parts that are formed on both ends of the connector body in a longitudinal direction and are fit in mating-connector-side mating guide parts formed on both ends of a mating connector body of a mating connector in the longitudinal direction. The lock devices include sliders attached to the mating guide parts to be slidable in the longitudinal direction of the connector body. The sliders each include a pair of right and left locking protrusions. When the connector body is mated with the mating connector body, the locking protrusions engage with mating reinforcement brackets installed on the mating connector body.

15 Claims, 14 Drawing Sheets

(51) Int. Cl.

| | |
|---|---|
| ***H01R 13/631*** | (2006.01) |
| ***H01R 12/72*** | (2011.01) |
| *H01R 12/57* | (2011.01) |
| *H01R 12/73* | (2011.01) |
| *H01R 107/00* | (2006.01) |
| *H01R 12/71* | (2011.01) |

(52) U.S. Cl.
CPC ..... *H01R 12/57* (2013.01); *H01R 12/716* (2013.01); *H01R 12/73* (2013.01); *H01R 2107/00* (2013.01)

(58) Field of Classification Search
USPC ..... 439/329
See application file for complete search history.

(56) References Cited

U.S. PATENT DOCUMENTS

| | | | | |
|---|---|---|---|---|
| 9,537,244 | B2 * | 1/2017 | Miyazaki | H01R 12/73 |
| 9,997,852 | B2 * | 6/2018 | Chen | H01R 12/7017 |
| 10,109,942 | B2 * | 10/2018 | Sugaya | H01R 13/2464 |
| 2017/0104285 | A1 * | 4/2017 | Yoshioka | H01R 4/02 |

FOREIGN PATENT DOCUMENTS

| | | | |
|---|---|---|---|
| CN | 103915723 | A | 7/2014 |
| CN | 104112948 | A | 10/2014 |
| CN | 104348030 | A | 2/2015 |
| CN | 106486837 | A | 3/2017 |
| CN | 107809017 | A | 3/2018 |
| JP | H04-368783 | A | 12/1992 |
| JP | H06-76883 | A | 3/1994 |
| JP | 2011-065861 | A | 3/2011 |
| JP | 2013-161578 | A | 8/2013 |
| JP | 2015-060804 | A | 3/2015 |
| KR | 10-2014-0125300 | A | 10/2014 |
| KR | 2015-0040212 | A | 4/2015 |
| KR | 10-2016-0126894 | A | 11/2016 |
| TW | 201519525 | A | 5/2015 |
| TW | 201524033 | A | 6/2015 |

* cited by examiner

CONNECTOR AND CONNECTOR ASSEMBLY

RELATED APPLICATIONS

This application claims priority to U.S. Provisional Application No. 62/517,232, filed Jun. 9, 2017 and to Japanese Application No. 2017-122414, filed Jun. 22, 2017, both of which are incorporated herein by reference in their entirety.

TECHNICAL FIELD

The present disclosure relates to a connector and a connector assembly.

BACKGROUND ART

Conventionally, connectors such as board to board connectors, etc., have been used to electrically connect pairs of parallel circuit boards together. Such connectors are attached to mutually facing surface of a pair of circuit boards and are mated together so that electrical conduction is established. A technique for preventing the electrically connected state from being ruined by external force received or the like has been proposed (see, for example, Patent Document 1).

FIG. 14 is a partial cross-sectional view illustrating a conventional connector.

In the figure, 811 is a first housing that is a housing for a first connector mounted on a first circuit board 891, and 911 is a second housing that is a housing for a second connector mounted on a second circuit board 991. The first housing 811 is provided with a plurality of first terminals 861, and the second housing 911 is provided with a plurality of second terminals 961 that come into contact with the first terminals 861.

The first housing 811 is provided with a lock lever 851 for locking the second housing 911 mated with the first housing 811. The lock lever 851 includes a spring 853. When the first housing 811 and the second housing 911 are mated together, a distal end part 852 of the lock lever 851 enters and engages with an engagement hole 951 formed on the second housing 911, due to expanding force of the spring 853. This configuration prevents the first housing 811 and the second housing 911 from being separated from each other when external force or the like is received, and thus ensures an electrically connected state to be maintained.

Patent Document 1: Japanese Unexamined Patent Publication No. H04-368783

SUMMARY

The conventional connector only has one distal end part 852 of the lock lever 851 and one engagement hole 951, engaged with each other, provided on each of right and left sides of the first housing 811 and the second housing 911. Thus, when external force in a direction inclined relative to a mating direction of the first housing 811 and the second housing 911 due to the second circuit board 991 swinging relative to the first circuit board 891 for example, the engaged state of the distal end part 852 of the lock lever 851 and the engagement hole 951 might be ruined, and thus the mated state of the first housing 811 and the second housing 911 might be ruined.

An object herein is to solve the problem of the conventional connector, and to provide a connector and a connector assembly achieving high reliability with the connector certainly locked to a mating connector to be certainly maintained to be mated with the mating connector.

To address this, a connector includes: a connector body; terminals installed in the connector body; and lock devices fit to the connector body. The connector body includes mating guide parts that are formed on both ends of the connector body in a longitudinal direction and are fit in mating-connector-side mating guide parts formed on both ends of a mating connector body of a mating connector in the longitudinal direction. The lock devices include sliders attached to the mating guide parts to be slidable in the longitudinal direction of the connector body. The sliders each include a pair of right and left locking protrusions. When the connector body is mated with the mating connector body, the locking protrusions engage with mating reinforcement brackets installed on the mating connector body.

In another connector, the lock devices further include reinforcement brackets mounted on the connector body and biasing members that bias the sliders, the reinforcement brackets cover at least a part of an outer side of the sliders attached to mating guide parts, and the biasing members bias the sliders in such a direction that the locking protrusions are engaged with the mating reinforcement brackets.

In yet another connector, the mating guide parts each include a slider holding part in which a biasing member containing part that contains the biasing member is formed, the slider holding part extending in the longitudinal direction of the connector body, the sliders each include a body part that has a flat plate shape and is slidably placed on an upper surface of the corresponding slider holding part, and a biasing force receiving part that is connected to a front end of the body part and enters the corresponding biasing member containing parts to come into contact with one end of the corresponding biasing member, and the locking protrusions are respectively connected to both right and left ends of the body part, and face outer side surfaces of wall members on both sides of the slider holding parts.

In yet another connector, the reinforcement brackets each include a first body part that has a flat plate shape and is placed on an upper surface of the body part of the corresponding slider in such a manner as to be slidable relative to the body part, a pair of right and left front side leg parts that are respectively connected to both right and left ends of the first body part and cover at least a part of outer side surfaces of the locking protrusions, and back side leg parts that are connected to a back end of the first body part and mated with the mating guide part.

In yet another connector, the locking protrusions each include protrusion pieces protruding outward beyond outer side surfaces of the front side leg parts.

In yet another connector, each of the reinforcement brackets further includes a pair of right and left connection arm parts having base ends connected to front ends of the front side leg parts, contact arm parts that come into contact with the corresponding mating reinforcement bracket are connected to a free end of each of the connection arm parts, and a side guide part is formed at a position closer to a base end of the connection arm part than to the free end, the side guide part guiding the corresponding mating-connector-side mating guide part when the connector body and the mating connector body are mated together.

A connector assembly includes: a connector; and a mating connector including a mating connector body on which mating reinforcement brackets are mounted, the mating connector body having mating-connector-side mating guide parts that are mated with mating guide parts of the connector and are formed on both ends in a longitudinal direction.

In another connector assembly, the mating reinforcement brackets include locking protrusion engagement parts that engage with the locking protrusions.

With the present disclosure, the connector is certainly locked to a mating connector mated with the connector. Thus, higher reliability is achieved with the connector and the mating connector certainly maintained to be in the mated state.

BRIEF DESCRIPTION OF THE DRAWINGS

FIGS. 3A and 3B are two surface views of the first connector according to the present embodiment, wherein FIG. 3A is an upper view and FIG. 3B is a side view.

FIGS. 10A-10C are three surface views illustrating the first connector and the second connector according to the present embodiment, immediately before the mating between the connectors is completed, wherein FIG. 10A is a side view, FIG. 10B is a cross-sectional view taken along line B-B in FIG. 10A, and FIG. 10C is a cross-sectional view taken along line A-A in FIG. 8.

FIGS. 11A-11C are partial perspective cross-sectional views of a main part in FIG. 9, illustrating positional relationship between the first connector and the second connector according to the present embodiment in a mating step, wherein FIG. 11A, FIG. 11B and FIG. 11C are diagrams illustrating steps in the mating step.

FIGS. 13A-13C are three surface views illustrating the first connector and the second connector according to the present embodiment after the connectors have been mated, wherein FIG. 13A is a side view and FIG. 13B and FIG. 13C are cross-sectional views similar to those in FIGS. 10B and 10C.

DETAILED DESCRIPTION OF THE PREFERRED EMBODIMENTS

Embodiments will be described in detail below with reference to the drawings.

Figure 1:
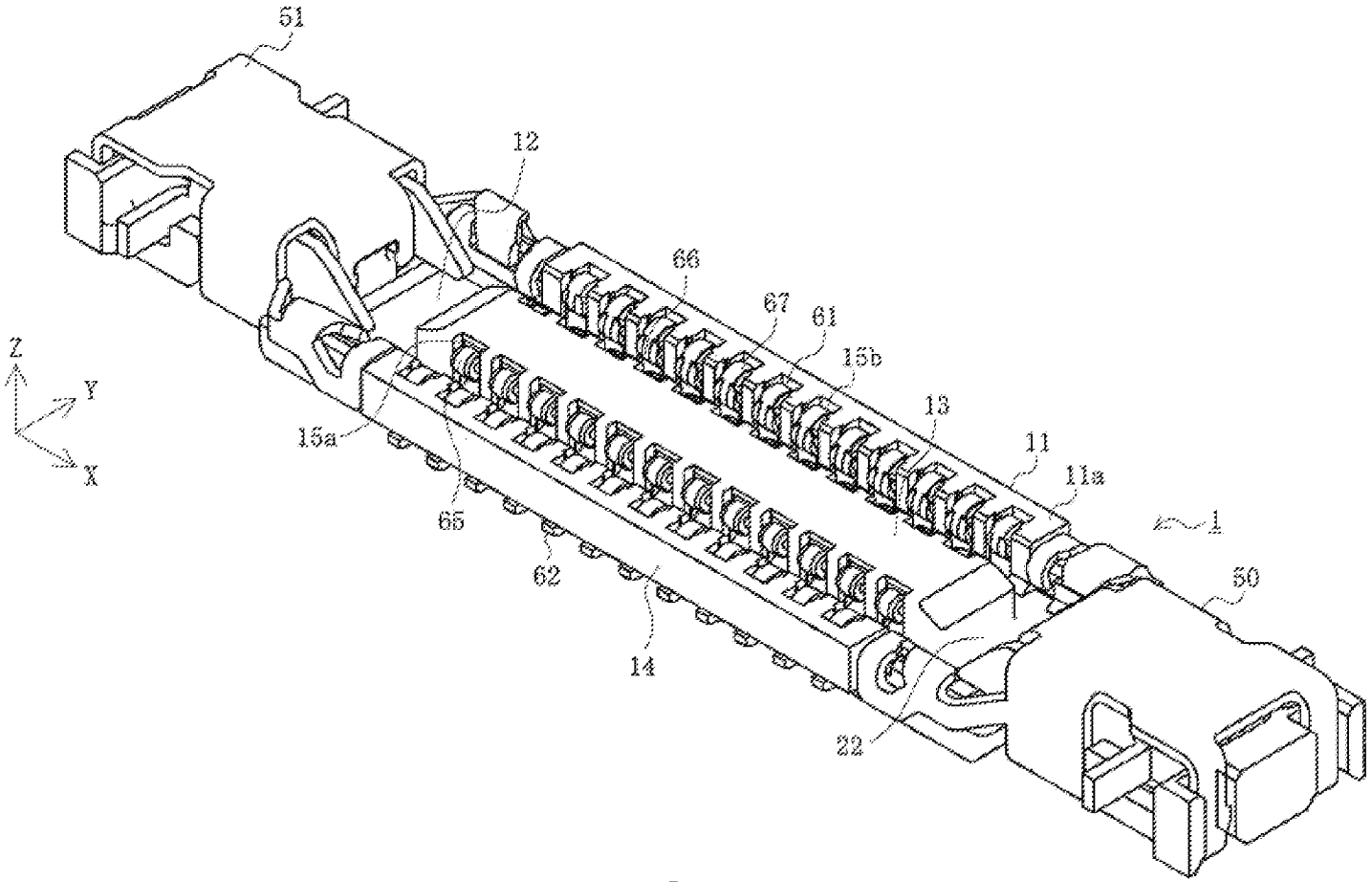
FIG. 1 is a perspective view of a first connector according to the present embodiment.
Figure 2:
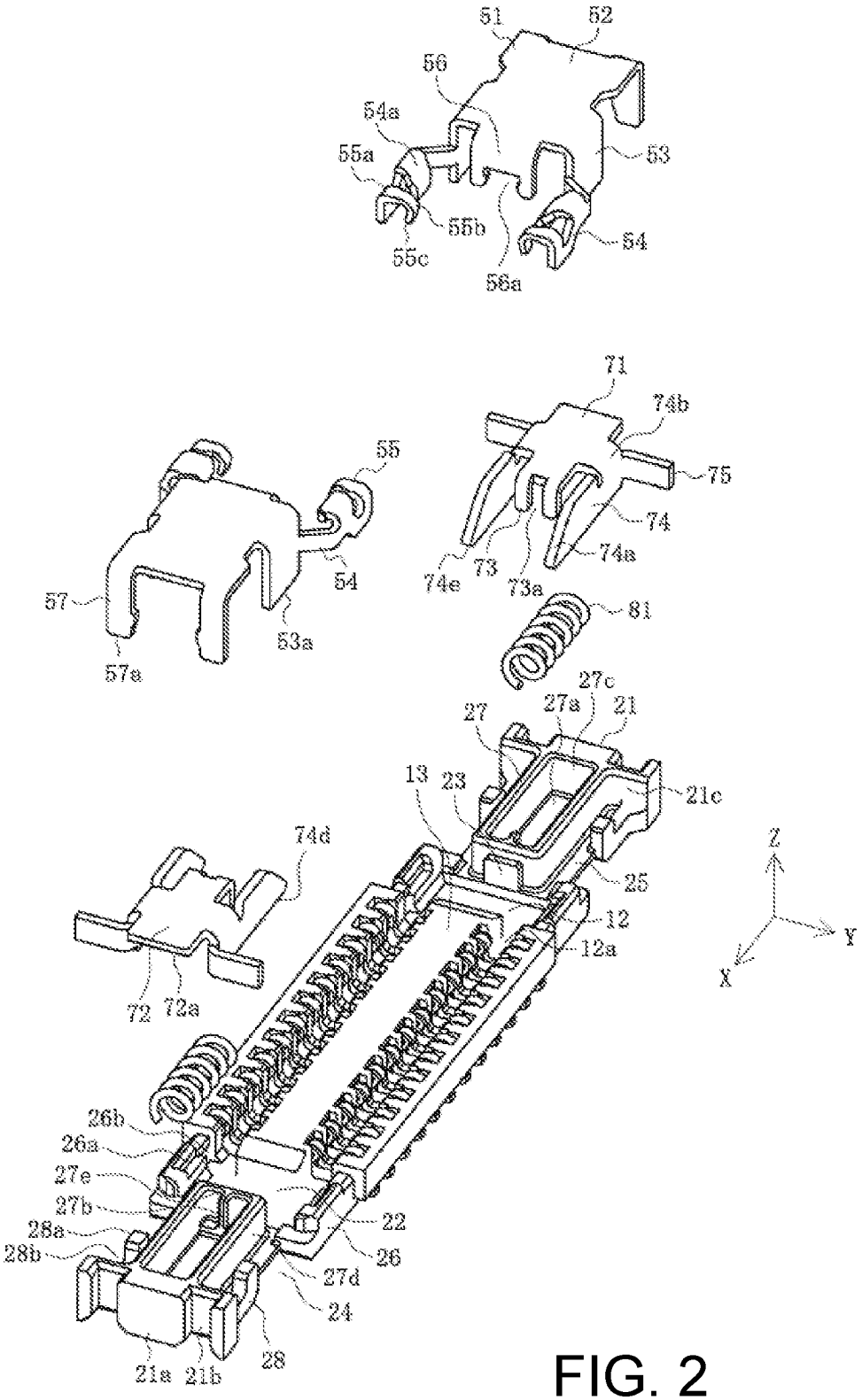
FIG. 2 is an exploded view of the first connector according to the present embodiment.
Figure 3A:
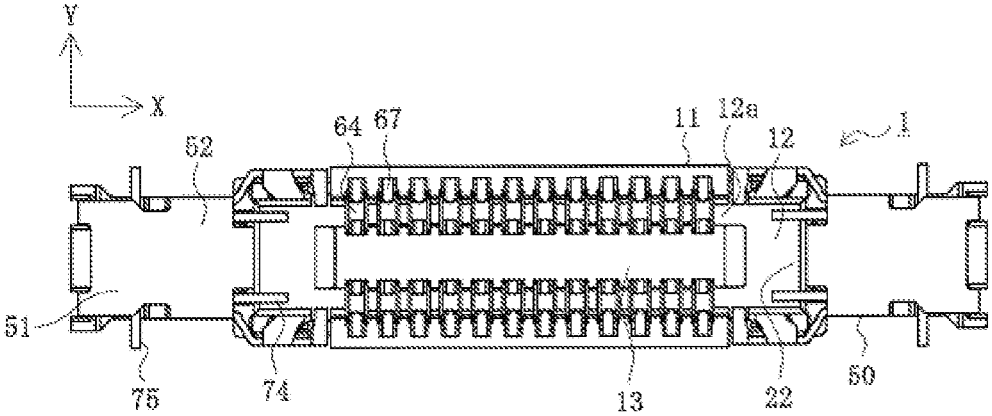
Figure 3B:
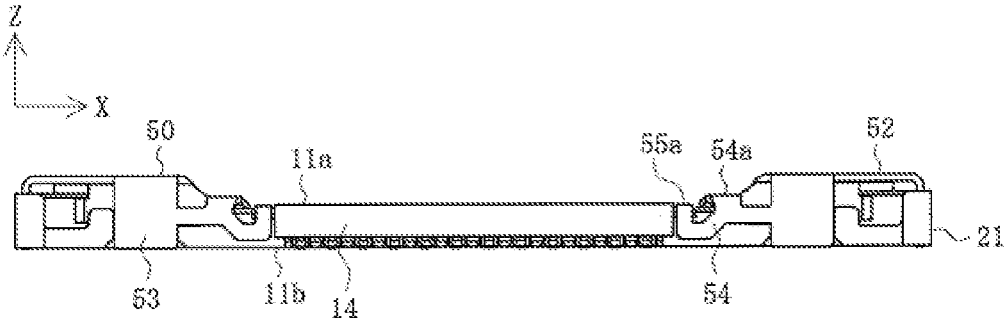

FIG. 1 is a perspective view of a first connector according to the present embodiment. FIG. 2 is an exploded view of the first connector according to the present embodiment. FIGS. 3A and 3B are two surface views of the first connector according to the present embodiment. FIG. 3A is an upper view and FIG. 3B is a side view.

In the figure, 1 is a connector according to the present embodiment and is the first connector serving as one of a pair of board to board connectors forming a connector assembly. The first connector 1 is a surface mount type connector mounted on the surface of a first substrate not illustrated in the figure that serves as a mounting member, and is mated with a second connector 101 that serves as a mating connector described later. Furthermore, the second connector 101 is the other one of the pair of board to board connectors and is a surface mount type connector mounted on the surface of a second substrate 191 serving as a mounting member.

Note that while the first connector 1 and the second connector 101 according to the present embodiment forming a connector assembly are ideally used for electrically connecting substrates, that is, the first substrate and the second substrate 191 to each other, the connectors can be used to electrically connect other members as well. Examples of the first substrate and second substrate 191 include printed circuit boards, flexible flat cables (FFC), flexible printed circuits (FPC), etc. used in electronic equipment, etc., but may be any type of substrate. In this description, the first substrate is a printed circuit board and the second substrate 191 is an FFC.

Furthermore, expressions for indicating directions such as up, down, left, right, front, and back, used to describe the operations and configurations of the parts of the first connector 1 and the second connector 101 in the present embodiment are not absolute but rather relative directions, and though appropriate when the parts of the first connector 1 and the second connector 101 are in the positions illustrated in the figures, these directions should be interpreted differently when these positions change, to correspond to said change.

Furthermore, the first connector 1 has a first housing 11 serving as a connector body integrally formed of an insulating material such as a synthetic resin. As illustrated in the figure, the first housing 11 is a substantially rectangular parallelepiped member having a substantially rectangular thick plate shape. A substantially rectangular recess 12, in which a second housing 111 described later fits, having the circumference surrounded is formed on the side of the housing in which the second connector 101 fits, that is, on the side of the mating surface 11*a* (the positive Z axis direction side). For example, the first connector 1 has a longitudinal length of 11 mm, a lateral length of 2 mm, and a thickness of 1 mm. Note that these sizes can be changed as appropriate. In the recess 12, a first protrusion 13, serving as an insular part to be fit to a groove part 113 described later, is integrally formed with the first housing 11. Side walls 14 are integrally formed with the first housing 11, to be on both sides of the first protrusion 13 on both sides in the Y axis direction, while extending in parallel with the first protrusion 13.

Note that the first protrusion 13 and the side walls 14 protrude upward (positive Z axis direction) from the bottom surface of the recess 12 and extend in the longitudinal direction (X axis direction) of the first housing 11 Thus, groove parts 12*a* are formed on both sides of the first protrusion 13, as elongated recesses extending in the longitudinal direction of the first housing 11 and serving as part of the recess 12.

First terminal containing inner cavities 15*a*, each having a groove shape, are formed on both sides of the first protrusion 13. First terminal containing outer cavities 15*b*, each having a groove shape, are formed on inner side surfaces of the side walls 14. The first terminal containing inner cavities 15*a* and the first terminal containing outer cavities 15*b* are integrally connected to each other on the bottom surface of the groove parts 12*a*. Thus, the first terminal containing inner cavities 15*a* and the first terminal containing outer cavities 15*b* may be collectively referred to as first terminal containing cavities 15.

In the present embodiment, the first terminal containing cavities 15 are formed on both sides of the first housing 11 in a width direction (Y axis direction) to be arranged side by side along the longitudinal direction of the first housing 11. Specifically, a plurality of the cavities are formed on both sides of the first protrusion 13 at a predetermined pitch (0.35 mm for example). A plurality of first terminals 61 that are each a terminal installed in the first housing 11 while being contained in a corresponding one of the first terminal containing cavities 15, are also provided on both sides of the first protrusion 13 at the same pitch.

The first terminals 61 are each an integrated member formed by carrying out processing such as punching and bending on a conductive metal plate. The first terminals 61 each include a held part (not illustrated), a tail part 62 connected to a lower end of the held part, an upper connecting part 67 connected to an upper end of the held part, a second contact part 66 formed around an inner end of the upper connecting part 67, a lower connecting part 64 connected to the second contact part 66, and a first contact part 65 formed around a free end of the lower connecting part 64.

The held part extends in an upper and lower direction (Z axis direction), that is, in a thickness direction of the first housing 11, and is fit and held in the first terminal containing outer cavity 15*b*. The tail part 62 is connected to the held part in a bent manner, and extends outward in a right and left direction (Y axis direction), that is, in the width direction of the first housing 11 to be connected to a connection pad, coupled to a conductive trace of the first substrate, by soldering or the like. Typically, the conductive trace is a signal line. The upper connecting part 67 is connected to the held part in a bent manner, and extends inward in the width direction of the first housing 11.

The second contact part 66 is formed on an inner end of the upper connecting part 67 in a downwardly (negative Z axis direction) bent manner. The second contact part 66 is curved and protrudes inward in the width direction of the first housing 11. The lower connecting part 64 is connected to the lower end of the second contact part 66, and has a U shape in side view. The first contact part 65 that is bent to be in a U shape is formed around a free end of the lower connecting part 64, that is, around the inner upper end. The first contact part 65 is curved and protrudes outward in the width direction of the first housing 11.

The first terminal 61 is fit into the first terminal containing cavity 15 from a mounting surface 11*b* serving as the lower surface (a surface on the negative Z axis direction side) of the first housing 11. The first terminal 61 is fixed to the first housing 11 with both sides of the held part clamped by the side walls of the first terminal containing outer cavity 15*b*, formed on the inner side surface of the side wall 14. In this state, that is, in a state where the first terminal 61 is mounted on the first housing 11, the first contact part 65 and the second contact part 66 face each other while being positioned on both right and left sides of the groove part 12*a*.

The first terminal 61 is a member integrally formed by carrying out processing on a metal plate, and thus has a certain level of elasticity. The first contact part 65 and the second contact part 66 facing each other can have a distance therebetween is changeable due to elastic deformation, as is apparent from the shapes of these parts. Specifically, when second terminals 161, described later, of the second connector 101 are inserted between the first contact part 65 and the second contact part 66, the distance between the first contact part 65 and the second contact part 66 increases due to elastic deformation.

Moreover, first protruding end parts 21 as mating guide parts are disposed on both ends of the first housing 11 in the longitudinal direction. A lock device 50 that locks that mated state between the first connector 1 and the second connector 101 is attached to each of the first protruding end parts 21. The lock devices 50 each include a first reinforcement bracket 51, a slider 71, and a coil spring 81. A mating recess 22 that is a part of the recess 12 is provided to each first protruding end part 21. The mating recesses 22 are substantially rectangular recesses located on both ends of the groove parts 12*a* in the longitudinal direction. Additionally, in the state in which the first connector 1 and the second connector 101 are mated, second protruding end parts 122, described later, of the second connector 101 are inserted into the mating recesses 22.

The first protruding end parts 21 each include extension side walls 26 that are connected to outer ends of side walls 14 in the longitudinal direction of the first housing 11 and function as side walls of the mating recess 22, a slider holding part 27 that has a rectangular parallelepiped shape and extends in the longitudinal direction of the first housing 11, and an end wall 21*a* connected to the outer side of the slider holding part 27 in the longitudinal direction of the first housing 11. The slider holding part 27 includes a biasing member containing part 27*a* that is a recess with an upper surface (surface in a positive Z axis direction) open, a pair of slider guide side walls 27*d* that are wall members defining both sides of the biasing member containing part 27*a* in the Y axis direction and extending in the Z axis direction, a biasing member receiving part 27*c* that is an inner wall surface of the biasing member containing part 27*a* on the outer side in the longitudinal direction of the first housing 11, a slider receiving part 27*e* that is an inner wall surface of the biasing member containing part 27*a* on the inner side in the longitudinal direction of the first housing 11, and a biasing member stopping part 27*b* protruding from the slider receiving part 27*e*. An inner end protruding part 23 is formed on an outer surface of the slider holding part 27 on the inner side in the longitudinal direction of the first housing 11. The end wall 21*a* is a thick plate shaped part that is longer than the slider holding part 27 in the Y axis direction, and includes slider retracted position defining parts 21*c* serving as wall surfaces on the inner side of the longitudinal direction of the first housing 11 in portions protruding outward beyond the slider guide side wall 27*d* in a width direction of the first housing 11, and end part receiving grooves 21*b* that receive back side leg parts 57 of the first reinforcement bracket 51.

The coil spring 81, serving as a biasing member, is contained in the biasing member containing part 27*a*. The sliders 71 that are each a sliding part of a lock mechanism that locks the second connector 101 is attached to the slider holding part 27 to be slidable in the longitudinal direction of the first housing 11.

The sliders 71 are each integrally formed by carrying out processing such as punching or bending on a metal plate, and include a body part 72, a pair of locking protrusions 74, a biasing force receiving part 73, and protruding pieces 75. The body part 72 has a flat plate shape and extends along the X-Y plane. The pair of locking protrusions 74 are connected to both ends of the body part 72 in the Y axis direction via connecting bent parts 74*b*. The biasing force receiving part 73 is connected to a front end (inner end in the longitudinal direction of the first housing 11) of the body part 72. The protruding pieces 75 are connected to back ends (outer ends in the longitudinal direction of the first housing 11) of the locking protrusion 74. The locking protrusions 74 are members that have a flat plate shape, extends along the X-Z plane, and have sharp distal ends 74*e*. The locking protrusions 74 each have a lower end (end in the negative Z axis direction) surface serving as a slide surface 74*d* that linearly extends in the X axis direction, and has an upper end (ends in the positive Z axis direction) surface serving as an inclined surface 74*a* with the height decreasing toward the distal end 74*e*. An angle between the inclined surface 74*a* and the slide surface 74*d* is 45° for example. Note that this angle can be set as appropriate. The biasing force receiving part 73 is a flat plate shaped member extending downward (in the negative Z axis direction) from the front end of the body part 72, and is divided in two by a slit shaped recess 73*a* extending in an upper and lower direction along the width direction of the first housing 11. The protruding pieces 75 are flat plate shaped members extending outward from the back end of the locking protrusion 74 in the width direction of the first housing 11, and function as slider visual recognition part with which an operator or the like can visually recognize the position of the sliders 71. The back end 72*a* of the body part 72 also functions as the slider visual recognition part.

The sliders 71 are attached to the slider holding part 27 to surround the periphery of the slider holding part 27 with the biasing member containing part 27*a* containing the coil spring 81. Specifically, the body part 72 is slidably placed on the upper surface of the slider holding part 27. The biasing force receiving part 73 is placed in the biasing member containing part 27*a* to be in front of the coil spring 81 (on the inner side in the longitudinal direction of the first housing 11), and thus receives biasing force toward the front side applied by the coil spring 81. The back end of the coil spring 81 comes into contact with the biasing member receiving part 27*c*. When the biasing force receiving part 73 is deformed toward the inner side in the longitudinal direction of the first housing 11 due to the biasing force from the coil spring 81 to come into contact with the slider receiving part 27*e* in the biasing member containing part 27*a*, the biasing member stopping part 27*b* of the biasing member containing part 27*a* makes a relative movement to enter the recess 73*a* of the biasing force receiving part 73.

When the sliders 71 are each attached to the slider holding part 27, the inner side surface of the locking protrusion 74 faces the outer side surface of the slider guide side wall 27*d*, the lower side of the slide surface 74*d* is slidably supported by a slider lower side supporting part 25 protruding outward in width direction of the first housing 11 from the lower end of the slider guide side wall 27*d*, and a part of the outer side surfaces of the locking protrusion 74 faces the inner side surface of slider outer side supporting parts 28. The slider outer side supporting parts 28 extend toward the front side (toward the inner side in the longitudinal direction of the first housing 11) from the slider retracted position defining part 21*c*, are positioned on the outer side of a portion of the slider lower side supporting part 25 around the back end in the width direction of the first housing 11, and each have a substantially L shape on the X-Z plane. The slider outer side supporting parts 28 each include a protrusion 28*a* extending toward the upper side and a recess 28*b* between the protrusion 28*a* and the slider retracted position defining part 21*c*. The protruding piece 75 is slidable within a range defined by the recess 28*b*.

The outer side of the sliders 71 are at least partially covered by the first reinforcement bracket 51 serving as a reinforcement member that is a cover member, to be held so as not to be detached from the first housing 11. The first reinforcement bracket 51 is integrally formed by carrying out processing such as punching and bending on a conductive metal plate, and includes a first body part 52 that has a flat plate shape and extends along the X-Y plane, a pair of front side leg parts 53 connected to both right and left ends of the first body part 52, connection arm parts 54 that have a thin strip shape and extend toward the front side from the front ends of the front side leg parts 53, side guide parts 54*a* connected to the upper ends of the connection arm parts 54, contact arm parts 55 connected to the front ends of the connection arm parts 54, a center guide part 56 connected to the front end of the first body part 52, and the pair of back side leg parts 57 connected to portions around both right and left sides of the back end of the first body part 52.

Each of the front side leg parts 53 is a flat plate shaped member that extends downward from a side end of the first body part 52, and has a lower end serving as a front side substrate connection part 53*a* to be connected to a connection pad, coupled to the conductive trace of the first substrate, by soldering and the like. Preferably, the conductive trace is a power line. The center guide part 56 is a flat plate shaped member extending downward from the front end of the first body part 52, and has a lower end provided with a protrusion receiving opening 56*a*, which contains the inner end protruding part 23, at the center. The first reinforcement bracket 51 is positioned relative to the first protruding end parts 21 with the inner end protruding part 23 fit in the protrusion containing opening 56*a*. Each of the back side leg parts 57 is a flat plate shaped member extending downward from the back end of the first body part 52, and has a lower end serving as a back side substrate connection part 57*a* to be connected to a connection pad, coupled to the conductive trace (preferably, a power line) of the first substrate, by soldering and the like. The outer reinforcing bracket 51 is positioned relative to the first protruding end parts 21, with the back side leg parts 57 fit in the end part receiving grooves 21*b*.

The first reinforcement bracket 51 is attached to the first protruding end parts 21 to cover at least a part of the outer side of the sliders 71 attached to the slider holding part 27, and thus slidably holds the sliders 71. Specifically, the first body part 52 is placed on the body part 72 to be slidable relative to the body part 72, the inner end protruding part 23 fits in the protrusion containing opening 56*a*, and the back side leg parts 57 fit in the end part receiving grooves 21*b*. The back side substrate connection part 57*a* that is the lower end of the back side leg part 57 protrudes downward from the mounting surface 11*b* of the first housing 11. The front side leg parts 53 cover at least a part of the outer side surfaces of the locking protrusions 74 and is contained in side surface recesses 24 that are recessed space formed between the wall surface of the extension side walls 26 on the outer side in the longitudinal direction of the first housing 11 and the protrusions 28*a* of the slider outer side supporting parts 28. The front side substrate connection part

53*a* that is the lower end of the front side leg part 53 protrudes downward from the mounting surface 11*b* of the first housing 11. Each of the side guide parts 54*a* of the connection arm parts 54 covers at least a part of the upper side and an inner side surface of the guide part 26*a* of the extension side wall 26, and the contact arm parts 55 over at least a part of the upper sides and the inner side surfaces of arm receiving recess 26*b* of the extension side walls 26.

The side guide part 54*a* has a slope shaped upper surface functioning as a guiding surface that smoothly guides the second protruding end parts 122 of the second connector 101 into the mating recess 22, when the first connector 1 and the second connector 101 are mated together. The contact arm parts 55 each include an upper curved part 55*a* facing the upper side, contact body parts 55*b* having base ends connected to the distal ends of the upper curved parts 55*a* and bulging toward the inner side of the mating recess 22, and lower end parts 55*c* that are distal ends of the contact body part 55*b*. When the first connector 1 and the second connector 101 are mated together, second reinforcement brackets 151 of the second connector 101 described later come into contact with a counterpart. As a result, the contact body parts 55*b* deform downward, and the lower end parts 55*c* can deform to be displaced toward the outer side in the width direction of the first housing 11.

In a state where the first reinforcement bracket 51 is thus attached to the first protruding end parts 21, as illustrated in FIG. 3B, the height of the upper surface of the upper curved part 55*a* (the size in the Z axis direction) from the mounting surface 11*b* of the first housing 11 is substantially the same as that of a mating surface 11*a* of the first housing 11. The height of the upper surface of the side guide part 54*a* is higher than that of the upper surface of the upper curved part 55*a*, and the height of the upper surface of the first body part 52 is higher than that of the upper surface of the side guide part 54*a*. The height of the upper surface of the first body part 52 corresponds to the thickness of the first connector 1 described above, and is approximately 1 mm. As illustrated in FIG. 3A, the size of the first reinforcement bracket 51 in the width direction (Y axis direction) is smaller than the size of the first housing 11 in the width direction (approximately 2 mm). A distance between the end part of the protruding pieces 75 on both ends is approximately the same as the size of the first housing 11 in the width direction.

Next, the configuration of second connector 101 will be described.

Figure 4:
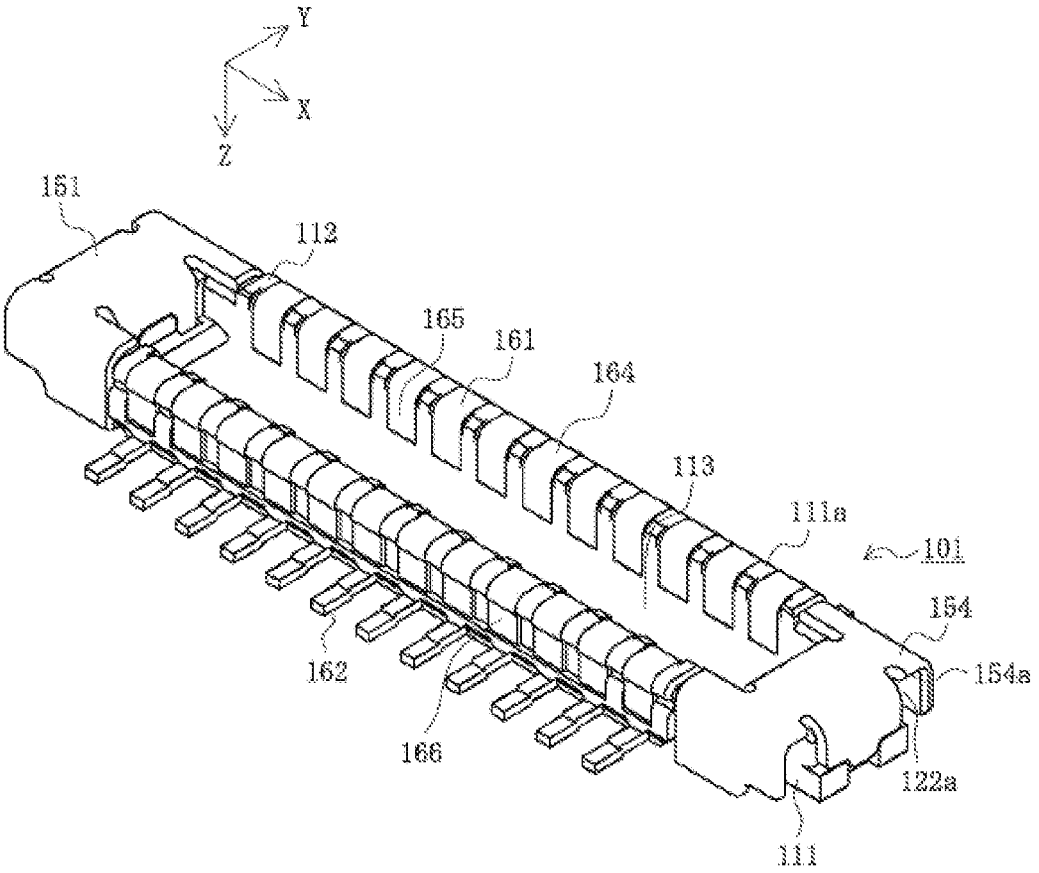
FIG. 4 is a perspective view of a second connector according to the present embodiment.
Figure 5:
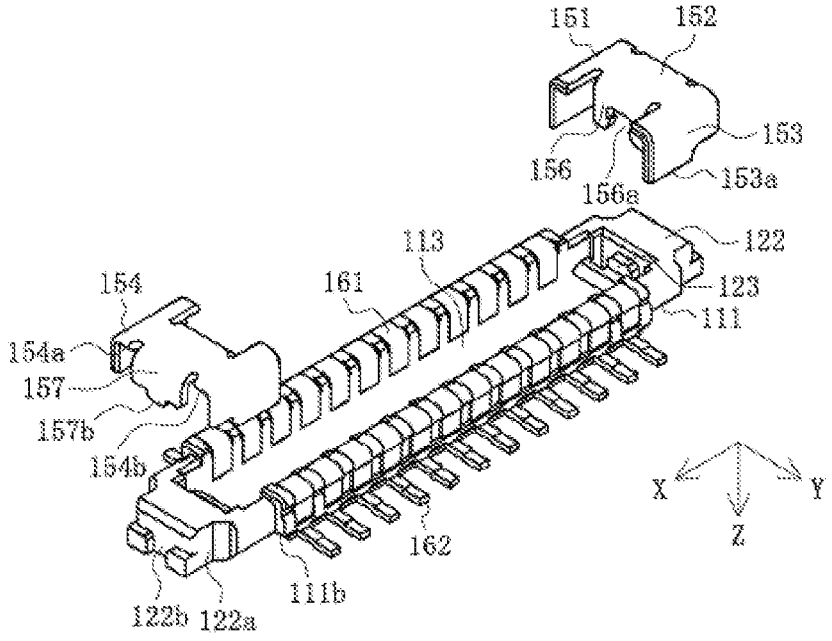
FIG. 5 is an exploded view of the second connector according to the present embodiment.

FIG. 4 is a perspective view of the second connector according to the present embodiment. FIG. 5 is an exploded view of the second connector according to the present embodiment.

The second connector 101 includes the second housing 111 serving as a mating connector body integrally formed of an insulating material such as a synthetic resin. As illustrated in the figure, the second housing 111 is a substantially rectangular parallelepiped member having a substantially rectangular thick plate shape. The elongated groove part 113, extending in the longitudinal direction (X axis direction) of the second housing 111, and second protrusions 112 are integrally formed on the side in which the second housing 111 fits in the first connector 1, that is, on a mating surface 111*a* side (negative Z axis direction side). The second protrusions 112 are thin elongate protrusions defining the outer sides of the groove part 113 while extending in the longitudinal direction of the second housing 111. The second protrusions 112 are formed along both sides of the groove part 113 and along both sides of the second housing 111. Additionally, the second terminals 161 as mating terminals are each provided to a corresponding one of the second protrusions 112. As illustrated in the figure, the groove part 113 has a side mounted on the second substrate 191, that is, the side of a mounting surface 111*b* (positive Z axis direction side) closed by a bottom part.

The second terminals 161 are each a member integrally formed by carrying out processing such as punching or bending on a conductive metal plate. The second terminal 161 includes a body part (not illustrated), a tail part 162 connected to the lower end of the body part, a first contact part 165 connected to the upper end of the body part, a connecting part 164 connected to the upper end of the first contact part 165, and a second contact part 166 connected to an outer end of the connecting part 164.

The body part is an unillustrated part held while having its circumference surrounded by the second housing 111. The tail part 162 is connected to the lower end of the body part extending in the right and left direction, that is, in the width direction of the second housing 111, extends outward from the second housing 111, and is connected to the connection pad, coupled to a conductive trace of the second substrate 191, by soldering or the like. Typically, the conductive trace is a signal line.

The second terminal 161 is integrated with the second housing 111 by a molding method referred to as overmolding or insert molding. Specifically, the second housing 111 is molded by filling the cavity of a mold, in which the second terminal 161 has been set beforehand, with an insulating material. Thus, the second terminal 161 is integrally attached to the second housing 111 with the body part embedded in the second housing 111 and with the surfaces of the first contact part 165, the connecting part 164, and the second contact part 166 exposed on the side surfaces of the second protrusion 112 and the mating surface 111*a*. The number the second terminals 161 and the pitch at which the second terminals 161 are arranged in the right and left direction are the same as those of the first terminals 61 of the first connector 1.

Moreover, the second protruding end parts 122 serving as mating-connector-side mating guide parts are disposed on both ends of the second housing 111 in the longitudinal direction. The second protruding end parts 122 is each a thick member that extends in the width direction (Y axis direction) of the second housing 111, and has both ends connected to both ends of a corresponding one of the second protrusions 112 in the longitudinal direction. In the state in which the first connector 1 and the second connector 101 are mated, the second protruding end parts 122 function as insertion protrusions inserted into the mating recess 22 of the first protruding end parts 21 included in the first connector 1.

Second reinforcement brackets 151 as mating reinforcement brackets are attached to the second protruding end parts 122. The second reinforcing brackets 151 in the present embodiment are members integrally formed by carrying out processing such as punching or bending on a metal plate. The second reinforcing brackets 151 each include a second body part 152 extending in the width direction of the second housing 111, side covering parts 154 that are connected to both right and left ends of the second body part 152, contact side plate parts 153 each connected to one side edge of a corresponding one of the side covering parts 154, a center covering part 156 that are connected to the front end (inner end in the longitudinal direction of the second housing 111) of the second body part 152, and a back side covering part 157 connected to the back end (outer end in the longitudinal direction of the second housing 111) of the second body part 152.

The second body part 152 is designed to have a shape and a size sufficient for covering most of the upper surface of the second protruding end parts 122, in the state where the second reinforcing brackets 151 are attached to the second protruding end parts 122. The side covering parts 154 extend from the right and left ends of the second body part 152 in the longitudinal direction of the second housing 111, and cover the upper surfaces around both ends of the second protrusion 112 in the longitudinal direction. The contact side plate parts 153 cover outer side surfaces around the both ends of the second protrusion 112 in the longitudinal direction, and each have a lower end serving as a substrate connection part 153*a* connected to a connection pad, coupled to a conductive trace of the second substrate 191, by soldering and the like. Preferably, the conductive trace is a power line. The center covering part 156 is a flat plate shaped member extending downward from the front end of the second body part 152, and has a lower end provided with a protrusion containing opening 156*a*, which contains the inner end protruding part 123 of the second protruding end parts 122, at the center. The second reinforcement brackets 151 are positioned relative to the second protruding end parts 122 with the inner end protruding part 123 fit in the protrusion containing opening 156*a*. The back side covering part 157 is a flat plate shaped member extending downward from the back end of the second body part 152, and has a lower end provided with a back side 157*b*, which enters the back end recess 122*b* of the second protruding end parts 122, at the center. The second reinforcement brackets 151 are positioned relative to the second protruding end parts 122 with the back side 157*b* fit in the back end recess 122*b*.

Locking protrusion receiving recesses 122*a* are formed on both right and left surfaces of the second protruding end parts 122. The locking protrusion receiving recesses 122*a* are each a recessed space extending from the back end of the second protruding end parts 122 toward the inner side in the longitudinal direction of the second housing 111, have outer side in the width direction covered by the contact side plate parts 153 of the second reinforcement brackets 151, and have the sides of the mating surfaces 111*a* covered by the side covering parts 154 of the second reinforcement brackets 151. The portion of the side covering part 154 covering the locking protrusion receiving recess 122*a* functions as a locking protrusion engagement part 154*a* engaged with a portion around the distal end 74*e* of the locking protrusion 74 that has entered the locking protrusion receiving recess 122*a*. The distal end 154*b* of the locking protrusion engagement part 154*a* while being in contact with the inclined surface 74*a* of the locking protrusion 74.

Next, an operation for mating the first connector 1 and the second connector 101 having the above-mentioned configuration will be described.

Figure 6:
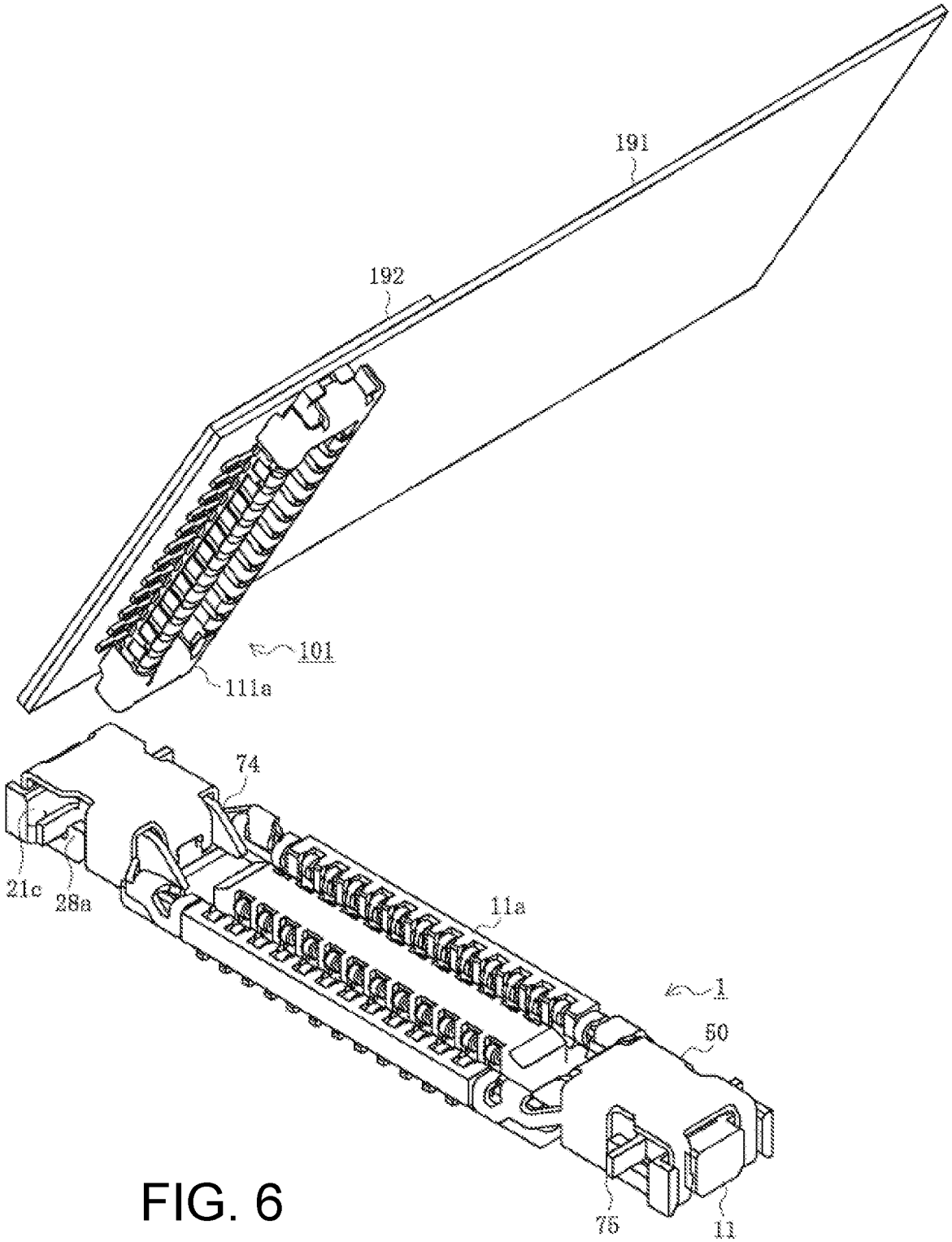
FIG. 6 is a perspective view illustrating positional relationship between the first connector and the second connector according to the present embodiment before the connectors are mated together.
Figure 7:
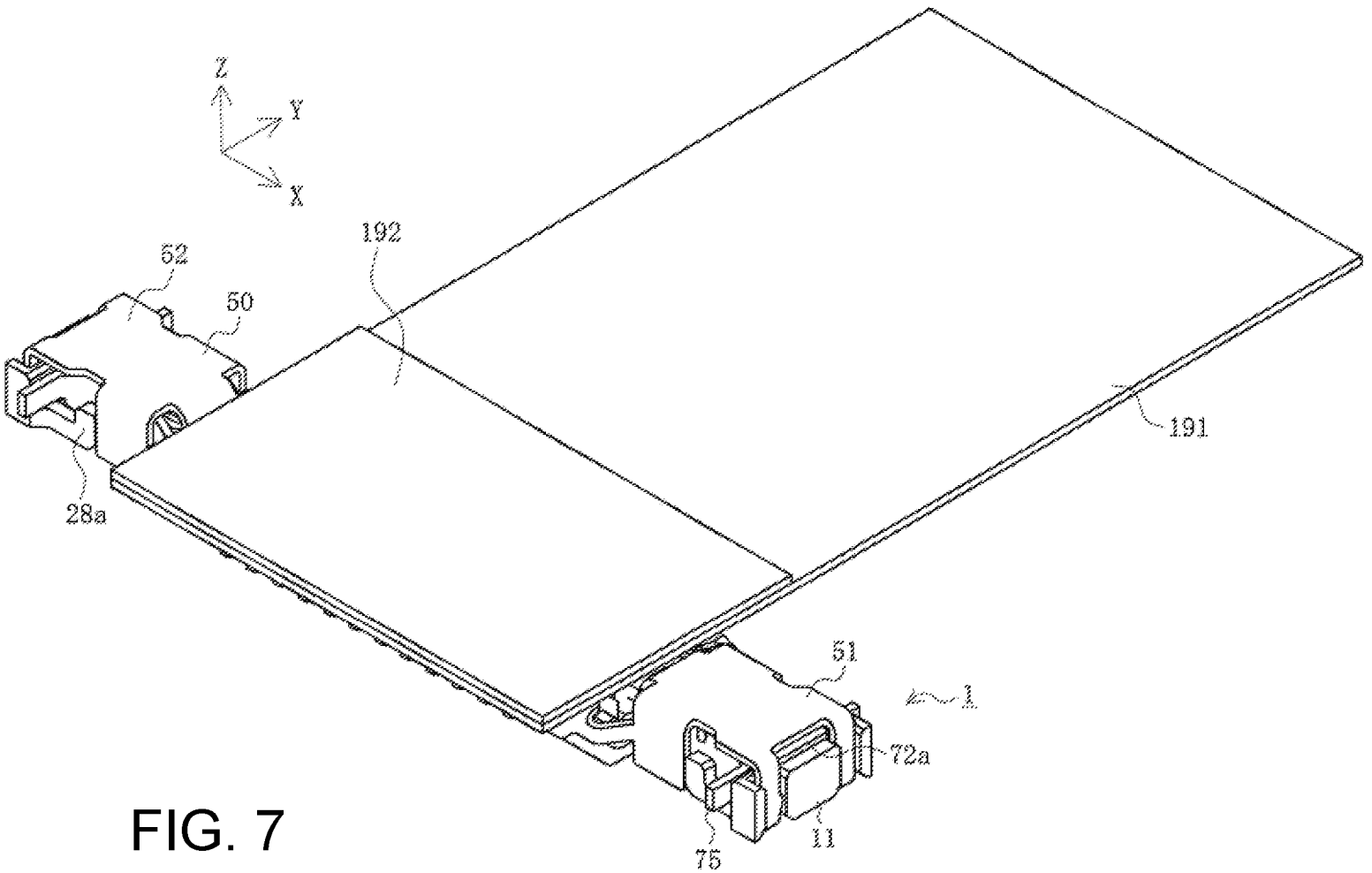
FIG. 7 is a perspective view illustrating the first connector and the second connector according to the present embodiment immediately before the mating between the connectors is completed.
Figure 8:
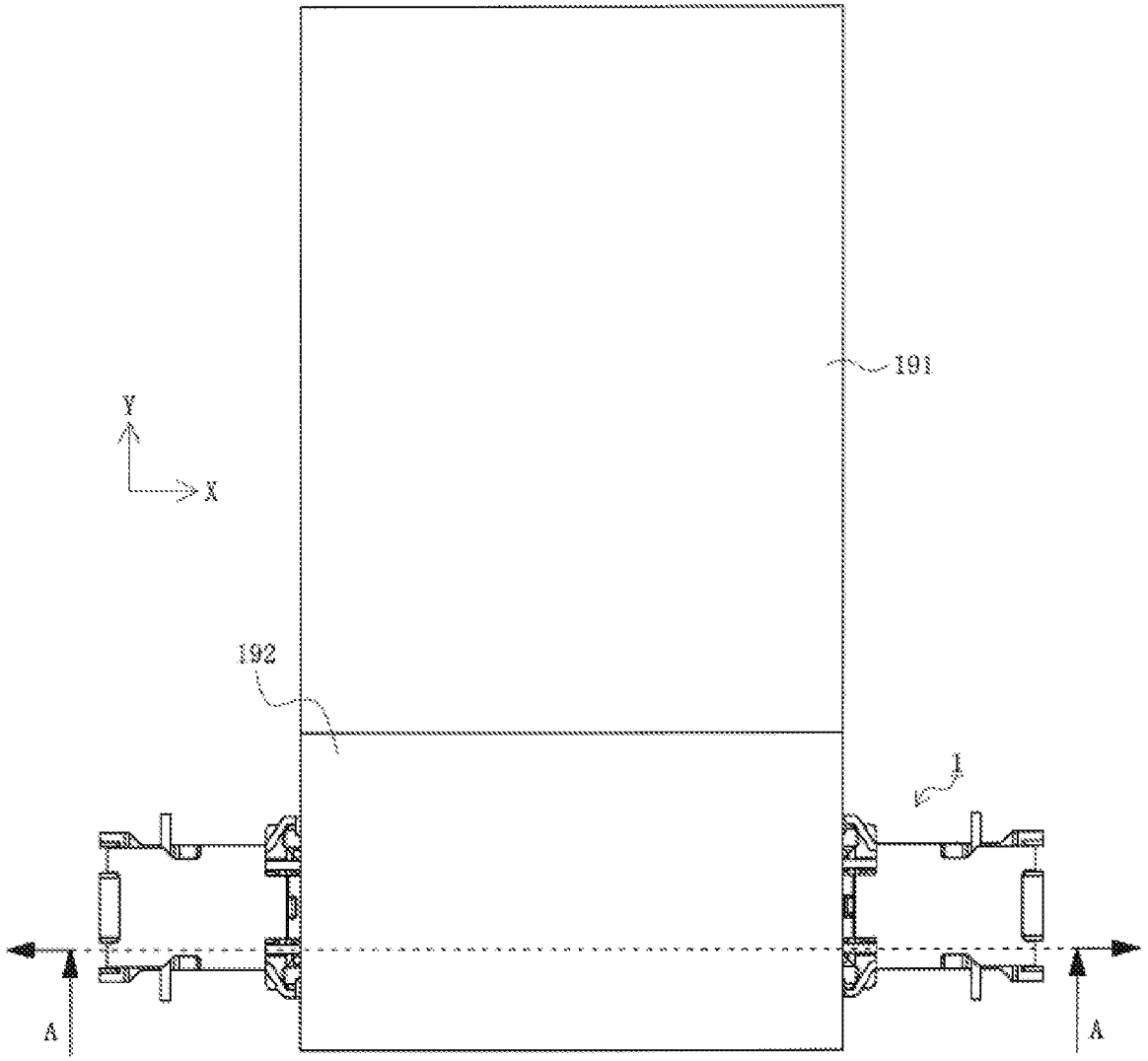
FIG. 8 is an upper view illustrating the first connector and the second connector according to the present embodiment immediately before the mating between the connectors is completed.
Figure 9:
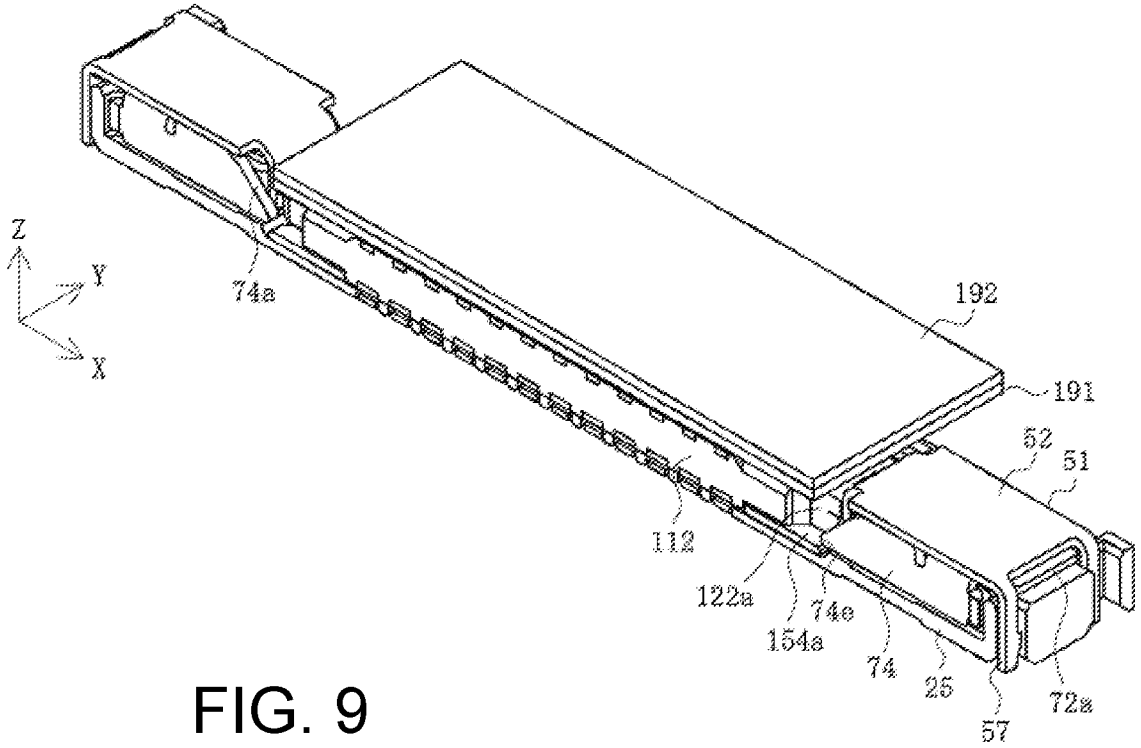
FIG. 9 is a perspective cross sectional view illustrating the first connector and the second connector according to the present embodiment, immediately before the mating between the connectors is completed, and is a cross-sectional view taken along line A-A in FIG. 8.
Figure 10A:
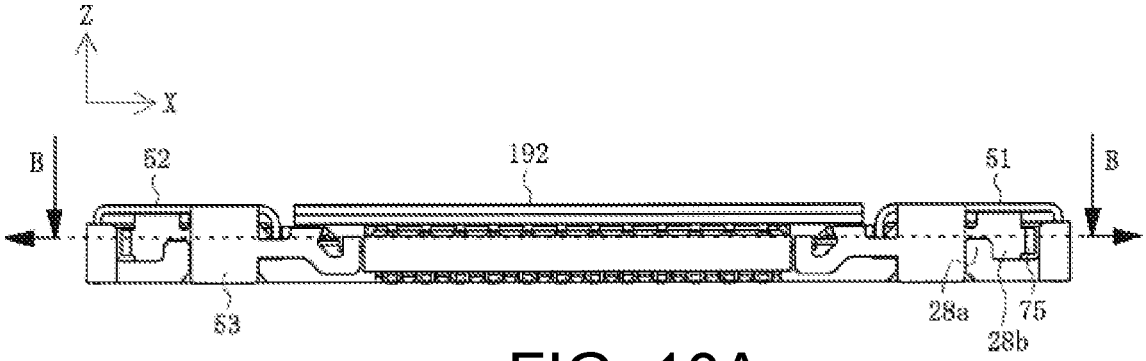
Figure 10B:
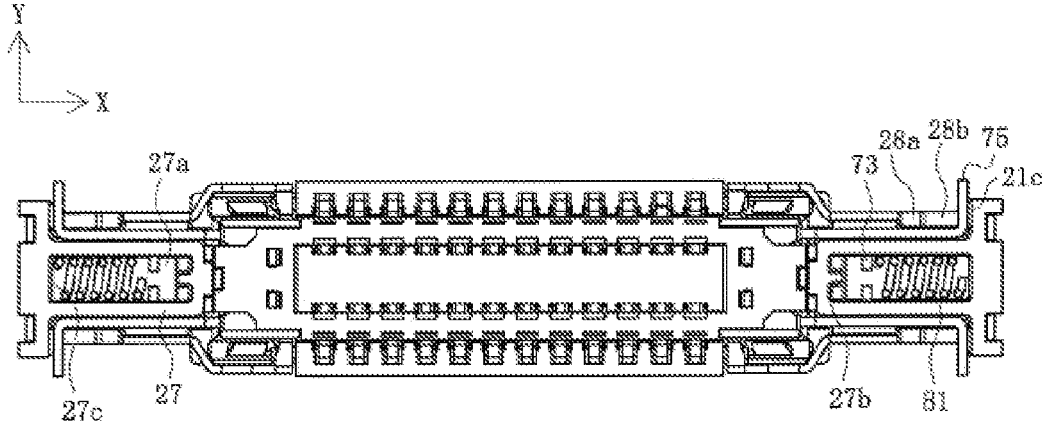
Figure 10C:
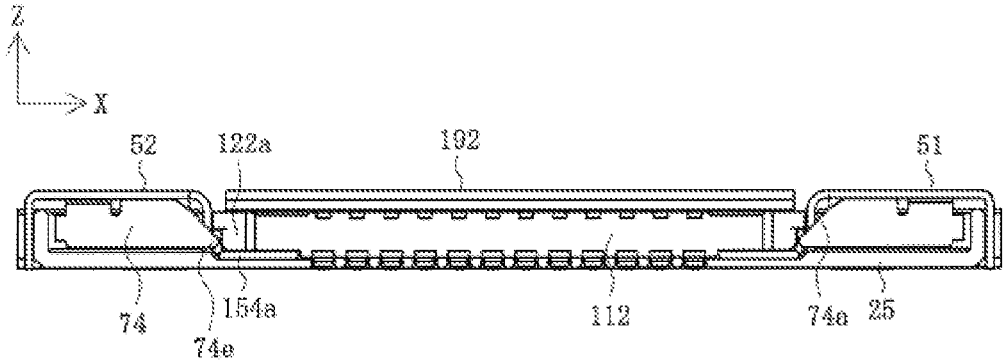
Figure 11A:
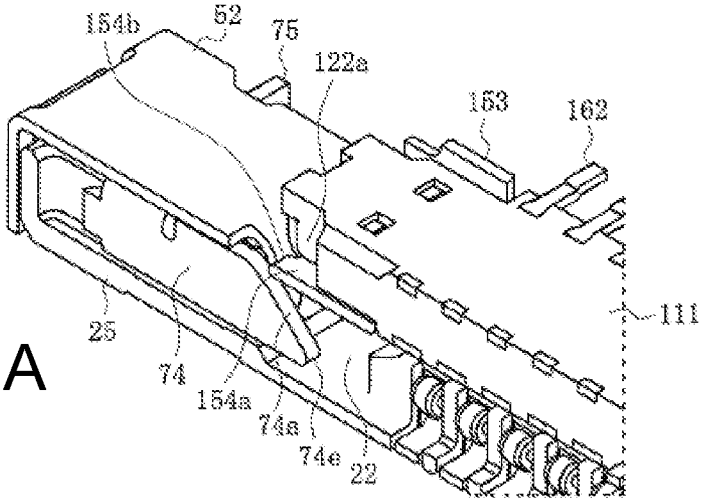
Figure 11B:
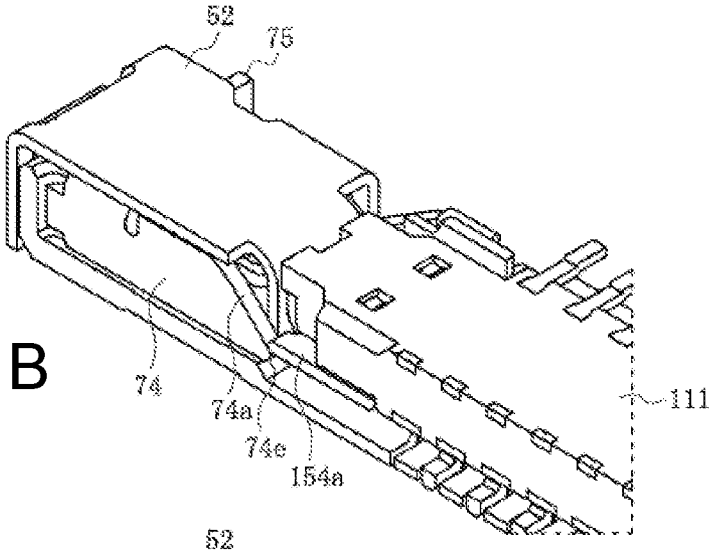
Figure 11C:
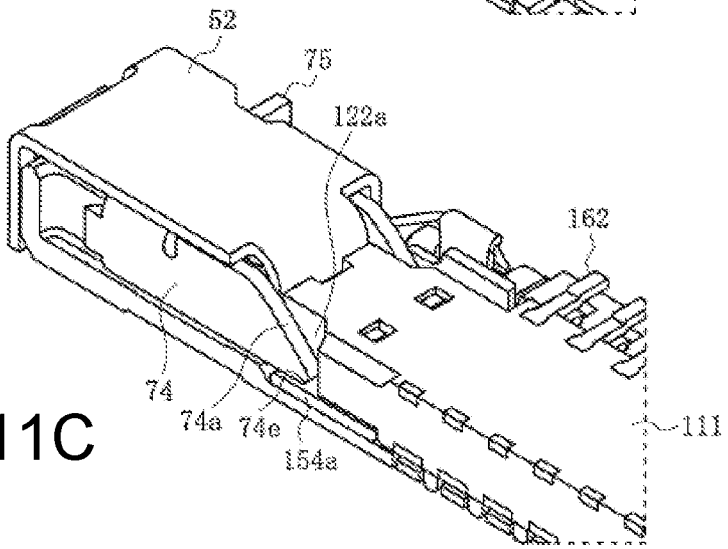
Figure 12:
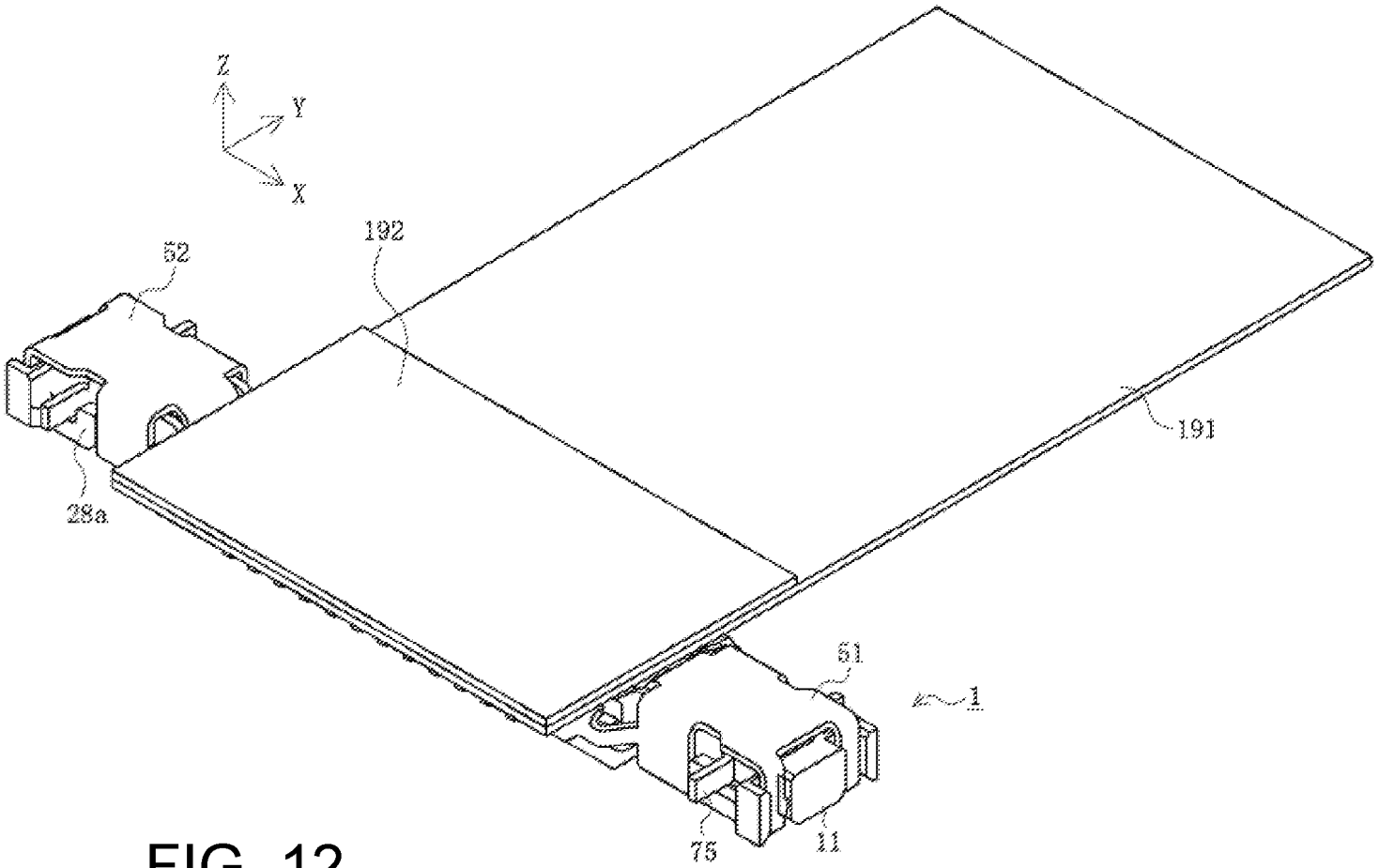
FIG. 12 is a perspective view illustrating the first connector and the second connector according to the present embodiment after the connectors have been mated.
Figure 13A:
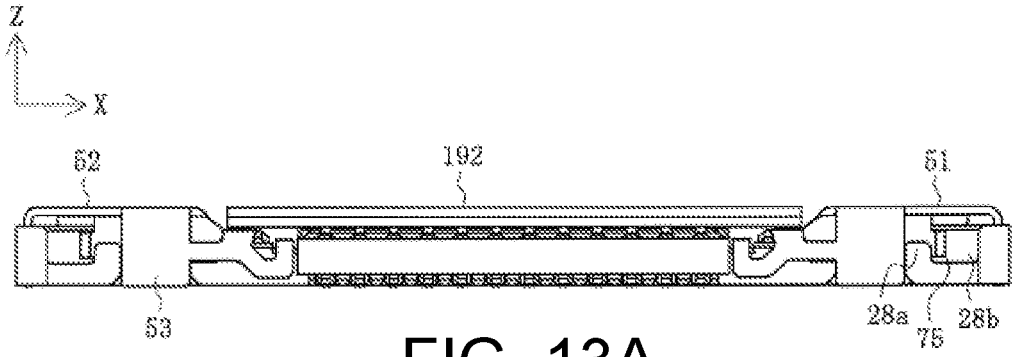
Figure 13B:
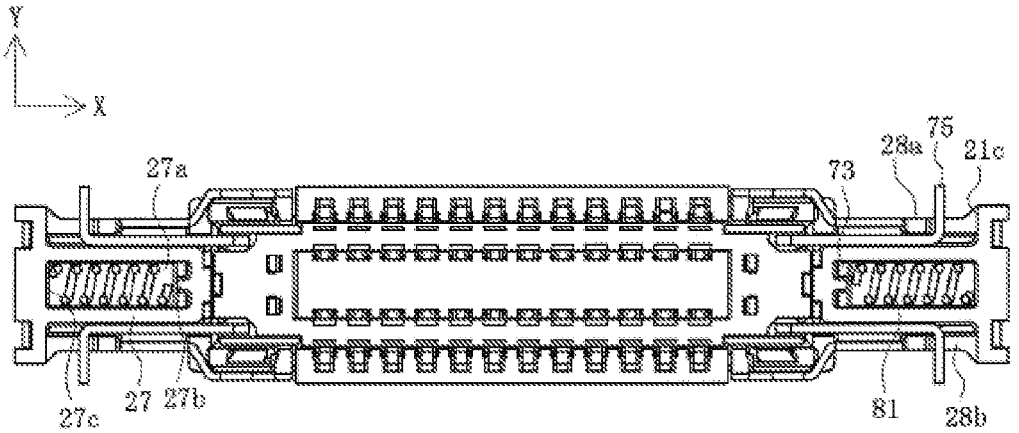
Figure 13C:
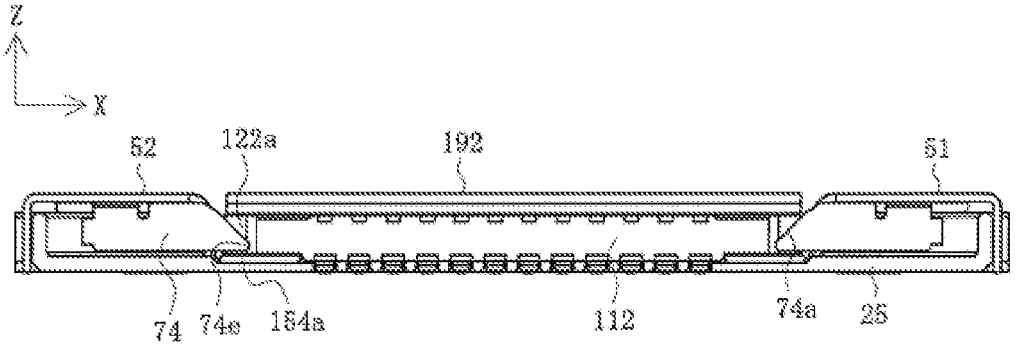
Figure 14:
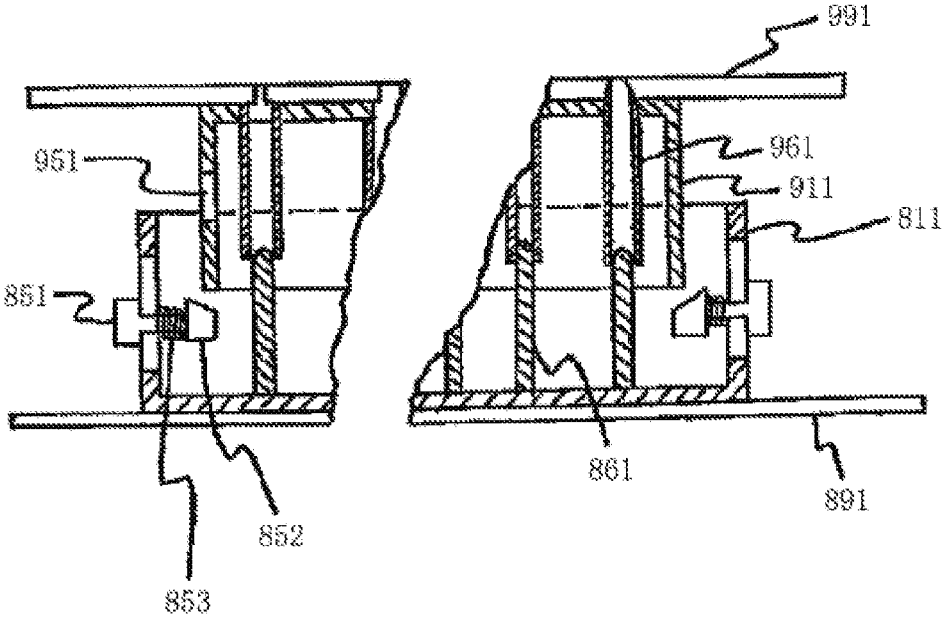
FIG. 14 Prior Art
FIG. 14 is a partial cross-sectional view illustrating a conventional connector.

FIG. 6 is a perspective view illustrating positional relationship between the first connector and the second connector according to the present embodiment before the connectors are mated together. FIG. 7 is a perspective view illustrating the first connector and the second connector according to the present embodiment immediately before the mating between the connectors is completed. FIG. 8 is an upper view illustrating the first connector and the second connector according to the present embodiment immediately before the mating between the connectors is completed. FIG. 9 is a perspective cross sectional view illustrating the first connector and the second connector according to the present embodiment, immediately before the mating between the connectors is completed, and is a cross-sectional view taken along line A-A in FIG. 8. FIGS. 10A through 10C are three surface views illustrating the first connector and the second connector according to the present embodiment, immediately before the mating between the connectors is completed. FIGS. 11A through 11C are partial perspective cross-sectional views of a main part in FIG. 9, illustrating positional relationship between the first connector and the second connector according to the present embodiment in a mating step. FIG. 12 is a perspective view illustrating the first connector and the second connector according to the present embodiment after the connectors have been mated. FIGS. 13A to 13C are three surface views illustrating the first connector and the second connector according to the present embodiment after the connectors have been mated. FIG. 10A is a side view, FIG. 10B is a cross-sectional view taken along line B-B in FIG. 10A, and FIG. 10C is a cross-sectional view taken along line A-A in FIG. 8. FIG. 11A, FIG. 11B and FIG. 11C are diagrams illustrating steps in the mating step. FIG. 13A is a side view and FIG. 13B and FIG. 13C are cross-sectional views similar to those in FIGS. 10B and 10C.

Note that hatching for cross-sections is omitted in FIG. 9, FIGS. 10A to 10C and FIGS. 11A to 11C for the sake of illustration.

The first connector 1 is mounted on the surface of the first substrate with the tail part 62 of the first terminal 61 connected to the connection pad, coupled to the conductive trace of the first substrate (not illustrated), by soldering or the like, and with the front side substrate connection part 53*a* and the back side substrate connection part 57*a* of the first reinforcement bracket 51 connected to the connection pad, coupled to the conductive trace of the first substrate, by soldering or the like. The conductive trace coupled to the connection pad to which the tail part 62 of the first terminal 61 is connected is a signal line. The conductive trace coupled to the connection pad to which the front side substrate connection part 53*a* and the back side substrate connection part 57*a* of the first reinforcement bracket 51 are connected is a power line.

Similarly, the second connector 101 is mounted on the surface of the second substrate 191 with the tail part 162 of the second terminal 161 connected to the connection pad, coupled to the conductive trace of the second substrate 191, by soldering or the like, and with the substrate connection part 153*a* of the second reinforcing brackets 151 connected to the connection pad, coupled to the conductive trace of the second substrate 191, by soldering or the like. The conductive trace coupled to the connection pad to which the tail part 162 of the second terminal 161 is connected is a signal line. The conductive trace coupled to the connection pad to which the substrate connection parts 153*a* of the second reinforcing brackets 151 are connected is a power line. The second substrate 191 is an FFC, and a reinforcement plate 192 is attached to portion of a surface (back surface) of the second substrate 191, opposite to the surface on which the second connector 101 is mounted, around the end part of the second substrate 191.

First of all, the operator establishes a state where the mating surface 11*a* of the first housing 11 of the first connector 1 and the mating surface 111*a* of the second housing 111 of the second connector 101 face each other as illustrated in FIG. 6.

Next, the operator aligns the positions of the second protrusion 112 of the second connector 101 with the positions of the corresponding groove parts 12*a* of the first connector 1, and aligns the positions of the second protruding end parts 122 of the second connector 101 with the positions of the corresponding mating recesses 22 of the first connector 1. Then, the first connector 1 and/or the second connector 101 is moved to toward the counterpart(s), that is, in the mating direction (Z axis direction). As a result, the second protrusions 112 and the second protruding end parts 122 of the second connector 101 can be inserted into the groove parts 12*a* and the mating recesses 22 of the first connector 1, as illustrated in FIG. 11A.

Before the first connector 1 and the second connector 101 are mated together, the sliders 71 are biased toward the inner side in the longitudinal direction of the first housing 11 due to the biasing force applied by the coil spring 81. Thus, as illustrated in FIG. 11A, the distal end 74*e* of the locking protrusion 74 protrudes into the mating recess 22 by a maximum amount, the biasing force receiving part 73 is in contact with the slider receiving part 27*e* in the biasing member containing part 27*a*, and the protruding piece 75 is in contact with the protrusion 28*a* defining the inner end of the recess 28*b* in the longitudinal direction of the first housing 11.

When the operator further moves the first connector 1 and/or the second connector 101 in the mating direction, as illustrated in FIG. 11B, the second protrusion 112 and the second protruding end parts 122 of the second connector 101 are inserted in the groove part 12*a* and the mating recess 22 of the first connector 1. The center guide part 56 of the first reinforcement bracket 51 are inclined to diagonally extend. Thus, the second protruding end parts 122 in contact with the center guide part 56 slide on the inclined surface of the center guide part 56 to be smoothly guided and inserted into the mating recess 22. The distal end 154*b* of the locking protrusion engagement part 154*a* of the side covering part 154 of each of the second reinforcement brackets 151 of the second connector 101 slides while being in contact with the inclined surface 74*a* of the locking protrusion 74 to relatively move toward the mounting surface 11*b* of the first housing 11. As a result, the locking protrusion 74 receives force toward the outer side in the longitudinal direction of the first housing 11, and thus moves toward the outer side in longitudinal direction of the first housing 11 against the biasing force on the biasing force receiving part 73.

When the distal end 154*b* of the locking protrusion engagement part 154*a* reaches the distal end 74*e* of the locking protrusion 74, as illustrated in FIG. 8, FIG. 9 and FIGS. 10A to 10C, the locking protrusion 74 is displaced toward the outer side in the longitudinal direction of the first housing 11 by the maximum amount, the protruding piece 75 becomes close to or comes into contact with the slider retracted position defining part 21*c*, and the back end 72*a* of the body part 72 becomes close to the back end of the first body part 52 to be visible from the outside. The second terminals 161 of the second connector 101 are almost completely inserted between the first and the second contact parts 65 and 66 of the first terminals 61.

Next, the distal end 154*b* of the locking protrusion engagement part 154*a* further relatively moves toward the mounting surface 11*b* of the first housing 11. When the distal end 154*b* passes through the distal end 74*e* of the locking protrusion 74, the first connector 1 and the second connector 101 are mated together as illustrated in FIG. 12 and FIGS. 13A to 13C. When the first connector 1 and the second connector 101 are mated together, the second terminal 161 of the second connector 101 is inserted between the first contact part 65 and the second contact part 66 of each of the first terminals 61. As a result, the first contact part 65 of the first terminal 61 comes into contact with the first contact part 165 of the second terminal 161, and the second contact part 66 of the first terminal 61 comes into contact with the second contact part 166 of the second terminal 161. As a result, the conductive trace coupled to the connection pad on the first substrate to which the tail part 62 of the first terminal 61 is connected becomes conductive with the conductive trace coupled to the connection pad on the second substrate 191 to which tail part 162 of the second terminal 161 is connected. The second reinforcement brackets 151 are inserted to be on the inner side of the first reinforcement bracket 51. As a result, the contact body parts 55*b* of the right and left contact arm parts 55 of the first reinforcement bracket 51 come into contact with the right and left contact side plate parts 153 of the second reinforcement brackets 151. As a result, the conductive trace coupled to the connection pad on the first substrate to which the front side substrate connection part 53*a* or the back side substrate connection part 57*a* of the first reinforcement bracket 51 is connected becomes conductive with the conductive trace coupled to the connection pad on the second substrate 191 to which the substrate connection parts 153*a* of the second reinforcement brackets 151 are connected.

When the first connector 1 and the second connector 101 are mated together, the distal end 154*b* of the locking protrusion engagement part 154*a* is separated from the inclined surface 74*a* of the locking protrusion 74. Thus, the sliders 71 move toward the inner side in the longitudinal direction of the first housing 11 due to the biasing force applied on the biasing force receiving part 73. As illustrated in FIG. 11C, the distal end 74*e* of the locking protrusion 74 and its periphery enters the locking protrusion receiving recess 122*a* to be engaged with the locking protrusion engagement part 154*a*. As a result, displacement of the second reinforcement brackets 151 including the locking protrusion engagement part 154*a* in a direction opposite to the mating direction of the is disabled. Thus, the coupled state of the first reinforcement bracket 51 and the second reinforcement brackets 151 is maintained, whereby the mated state of the first connector 1 and the second connector 101 is locked.

As described above, the first connector 1 and the second connector 101 mated to each other are locked with the pair of locking protrusions 74 engaged with the pair of locking protrusion engagement part 154*a*. The pair of locking protrusions 74 are formed on both sides of each of the sliders 71 in the width direction of the first housing 11, attached to both ends of the first housing 11 in the longitudinal direction (X axis direction), in the width direction (Y axis direction). The pair of locking protrusion engagement parts 154*a* are formed on both sides of each of the second reinforcement brackets 151 in the width direction of the second housing 111, attached to both ends of the second housing 111 in the longitudinal direction (X axis direction), in the width direction (Y axis direction). Thus, the postures of the sliders 71 and the locking protrusion engagement part 154*a* can be prevented from being unstable. The sliders 71 are rigid and thus are unlikely to deform. Thus, the mating is not unlocked by large external force, which would unlock the mating in conventional examples.

The first reinforcement bracket 51 that covers and holds the sliders 71 is connected to the first substrate with the front side substrate connection parts 53*a* connected to the connection pad on the first substrate. The front side substrate connection parts 53*a* are the lower ends of the pair of front side leg parts 53 positioned to be close to the distal ends 74*e* of the locking protrusions 74 that engage with the locking protrusion engagement parts 154*a* of the second reinforcement brackets 151. The pair of back side leg parts 57 are fit in the end part receiving grooves 21*b*. Thus, stable posture of the first reinforcement bracket 51 relative to the first protruding end parts 21 is achieved, and the back side substrate connection parts 57*a* that are the lower ends of the back side leg parts 57 are connected to the front side substrate connection parts 53*a* and to the connection pad on the first substrate. This ensures the connection between the first reinforcement bracket 51 and the first substrate to be maintained and thus ensures the mating to be unlocked, even when large external force, which would unlock the mating in conventional examples is applied.

The pair of locking protrusion engagement parts 154*a* engaged with the pair of locking protrusions 74 are disposed close a bend part that is the connection part between the side covering parts 154 of the second reinforcement brackets 151 and the contact side plate parts 153, and thus has high rigidity to be less likely to deform. This ensures the engaged state of the locking protrusion 74 and the locking protrusion engagement part 154*a* to be prevented from being ruined and thus ensures the mating to be unlocked, even when large external force, which would unlock the mating in conventional examples is applied.

Furthermore, as illustrated in FIG. 13A, in the state where the first connector 1 and the second connector 101 are mated together, the position of the back surface of the reinforcement surface 192 attached to the second substrate 191, on which the second connector 101 is mounted, in the Z axis direction substantially matches the position of the upper surface of the first reinforcement bracket 51 of the first connector 1 in the Z axis direction.

When the first connector 1 and the second connector 101 mated together need to be detached from each other, the operator uses an unillustrated jig having a pair of thin arm members such as a pair of tweezers for example. Specifically, distal ends of the arm members are engaged with the protruding piece 75, to make the protruding piece 75 deformed toward the slider retracted position defining part 21*c*. As a result, the locking protrusion 74 is deformed toward the outer side in the longitudinal direction of the first housing 11, and the distal end 74*e* of the locking protrusion 74 and its periphery retract to be outside the locking protrusion receiving recess 122*a*. Thus, the locking protrusion engagement part 154*a* is disengaged. Then, the operator can move the first connector 1 and/or the second connector 101 in the direction opposite to the mating direction, so that the first connector 1 and the second connector 101 are detached from each other.

In the present embodiment, the first connector 1 includes: the first housing 11; and the first terminals 61 installed in the first housing 11; and the lock devices 50 fit to the first housing 11. The first housing 11 includes first protruding end parts 21 that are formed on both ends of the first housing 11 in a longitudinal direction and are fit in the second protruding end parts 122 formed on both ends of the second housing 111 of the second connector 101 in the longitudinal direction. The lock devices 50 include the sliders 71 each attached to a corresponding one of the first protruding end parts 21 to be slidable in the longitudinal direction of the first housing 11, the sliders 71 each include the pair of locking protrusions 74, and when the first housing 11 is mated with the second housing 111, the locking protrusions 74 engage with the second reinforcement brackets 151 installed on the second housing 111.

Thus, the sliders 71 have improved strength and stable posture. This ensures the first connector 1 and the second connector 101 mated together to be locked, and ensures the mated state of the first connector 1 and the second connector 101 to be maintained, whereby higher reliability is achieved.

The lock devices 50 further include the first reinforcement brackets 51 mounted on the first housing 11 and the coil springs 81 that bias the sliders 71, the first reinforcement brackets 51 cover at least a part of an outer side of the sliders 71 attached to the first protruding end parts 21, and the coil springs 81 bias the sliders 71 in such a direction that the locking protrusions 74 are engaged with the second reinforcement brackets 151. Thus, the sliders 71 automatically slide while being certainly attached to the first protruding end parts 21, so that the second reinforcement brackets 151 can be certainly engaged.

The first protruding end parts 21 each include a slider holding part 27 in which a biasing member containing part 27*a* that contains the coil springs 81 is formed, the slider holding part 27 extending in the longitudinal direction of the first housing 11, the sliders 71 each include a body part 72 that has a flat plate shape and is slidably placed on an upper surface of the corresponding slider holding part 27, and a biasing force receiving part 73 that is connected to the front end of the body part 72 and enters the corresponding biasing member containing parts 27*a* to come into contact with one end of the corresponding coil spring 81, and the locking protrusions 74 are connected to both right and left ends of the body part 72, and face outer side surfaces of the slider guide side walls 27*d* on both sides of the slider holding parts 27. With this configuration, the sliders 71 can smoothly slide with a stable posture.

The first reinforcement brackets 51 each include a first body part 52 that has a flat plate shape and is placed on an upper surface of the body part 72 of the corresponding slider 71 in such a manner as to be slidable relative to the body part 72, the pair of right and left front side leg parts 53 that are respectively connected to both right and left ends of the first body part 52 and cover at least a part of outer side surfaces of the locking protrusions 74, and the back side leg parts 57 that are connected to a back end of the first body part 52 and mated with the first protruding end parts 21. This configuration ensures that the sliders 71 to be held by the first reinforcement bracket 51, whereby the mating can be prevented from being unlocked to be ruined.

The locking protrusions 74 each include the protrusion pieces 75 protruding outward beyond outer side surfaces of the front side leg parts 53. This configuration enables the position of the locking protrusion 74 to be visually recognized from the outside, whereby whether the locking protrusion 74 is engaged with the second reinforcement brackets 151 can be checked.

Each of the first reinforcement brackets 51 further includes a pair of right and left connection arm parts 54 having base ends connected to front ends of the front side leg parts 53, the contact arm parts 55 that come into contact with the corresponding second reinforcement bracket 151 are connected to a free end of each of the connection arm parts 54, and a side guide part 54*a* is formed at a position closer to a base end of the connection arm part 54 than to the free end, the side guide part 54*a* guiding the corresponding second protruding end parts 122 when the first housing 11 and the second housing 111 are mated together. With this configuration, the first protruding end parts 21 of the first housing 11 are appropriately protected by the first reinforcement bracket 51 so as not to be damaged or broken during the mating operation. Furthermore, this configuration ensures the state where the first reinforcing bracket 51 and the second reinforcement brackets 151 are engaged to be maintained, and thus ensures the state where the first reinforcing bracket 51 is conductive with the second reinforcement brackets 151 to be maintained, whereby the reliability can be improved.

The present disclosure provides a mere example, and modifications that are easily thought of by those skilled in the art without departing from the spirit of the present disclosure fall within the scope of the present disclosure. The width, thickness, shape, and the like of each component in the drawings are schematically illustrated and do not limit interpretation of the present disclosure.

Note that the disclosure of the present specification describes characteristics related to preferred and exemplary embodiments. Various other embodiments, modifications and variations within the scope and spirit of the claims appended hereto could naturally be conceived by persons skilled in the art by summarizing the disclosures of the present specification.

The present disclosure can be applied to connectors and connector assembly.

The invention claimed is:

1. A connector comprising:

a connector body;

terminals installed in the connector body; and a lock device fit to the connector body, wherein the connector body includes a mating guide part that is formed on a first end of the connector body in a longitudinal direction, the mating guide part being configured to fit in a mating-connector-side mating guide part formed on a first end of a mating connector body of a mating connector in the longitudinal direction, wherein the lock device has a slider attached to the mating guide part, the slider being slidable in the longitudinal direction, wherein the slider has right and left locking protrusions, and wherein, when the connector body is mated with the mating connector body, the locking protrusions are configured to engage with a mating reinforcement bracket installed on the mating connector body and the slider is configured to slide in the longitudinal direction.

2. The connector according to claim 1, wherein the lock device further includes a biasing member that biases the slider in a direction such that, when the connector body is mated with the mating connector body, the locking protrusions are engaged with the mating reinforcement bracket.

3. The connector according to claim 2, wherein the mating guide part has a slider holding part in which a biasing member containing part that contains the biasing member is formed, the slider holding part extending in the longitudinal direction of the connector body, the slider has a body part that has a flat plate shape and is slidably placed on an upper surface of the slider holding part, and a biasing force receiving part that is connected to a front end of the body part and enters the biasing member containing part to come into contact with one end of the biasing member, and the locking protrusions are connected to both right and left ends of the body part, and face outer side surfaces of wall members on both sides of the slider holding part.

4. The connector according to claim 3, wherein the lock device further has a reinforcement bracket mounted on the connector body, the reinforcement bracket covering at least a part of an outer side of the slider.

5. The connector according to claim 4, wherein the reinforcement bracket has a first body part that has a flat plate shape and is placed on an upper surface of the body part of the slider in such a manner as to be slidable relative to the body part, right and left front side leg parts that are respectively connected to both right and left ends of the first body part and cover at least a part of outer side surfaces of the locking protrusions, and back side leg parts that are connected to a back end of the first body part and mated with the mating guide part.

6. The connector according to claim 5, wherein the locking protrusions each include protrusion pieces protruding outward beyond outer side surfaces of the front side leg parts.

7. The connector according to claim 5, wherein the reinforcement bracket further has right and left connection arm parts having base ends connected to front ends of the front side leg parts, contact arm parts that are configured to come into contact with the corresponding mating reinforcement bracket are connected to a free end of each connection arm part, and a side guide part which is formed at a position closer to a base end of the connection arm part than to the free end, the side guide part configured to guide the corresponding mating-connector-side mating guide part when the connector body and the mating connector body are mated together.

8. The connector according to claim 1, wherein the locking device is a first locking device, wherein the mating guide part is a first mating guide part, wherein connector body includes a second mating guide part that is formed on a second end of the connector body in the longitudinal direction, the second mating guide part being configured to fit in a second mating-connector-side mating guide part formed on a second end of the mating connector body of the mating connector in the longitudinal direction, the connector further comprising a second locking device fit to the connector body, wherein the second lock device has a second slider attached to the second mating guide part, the second slider being slidable in the longitudinal direction, wherein the second slider has right and left locking protrusions, and wherein, when the connector body is mated with the mating connector body, the locking protrusions of the second slider are configured to engage with a second mating reinforcement bracket installed on the mating connector body and the second slider is configured to slide in the longitudinal direction.

9. A connector assembly comprising:

a first connector comprising:

a first connector body;

first terminals installed in the first connector body; and a first lock device fit to the first connector body, wherein the first connector body includes a first mating guide part that is formed on a first end of the first connector body in a longitudinal direction, wherein the first lock device has a first slider attached to the first mating guide part, the first slider being slidable in the longitudinal direction, wherein the first slider has right and left locking protrusions; and a second connector comprising:

a second connector body;

second terminals installed in the second connector body; and a second reinforcement bracket, wherein the second connector body includes a second mating guide part that is formed on a first end of the second connector body in the longitudinal direction, wherein the second reinforcement bracket is attached to the second mating guide part, wherein the first mating guide part is fit in the second mating guide part, and wherein the locking protrusions engage with the second reinforcement bracket and the first slider is slidable in the longitudinal direction.

10. The connector assembly according to claim 9, wherein the first lock device further includes a biasing member that biases the slider in a direction such that the locking protrusions are engaged with the second reinforcement bracket.

11. The connector assembly according to claim 10, wherein the first mating guide part has a slider holding part in which a biasing member containing part that contains the biasing member is formed, the slider holding part extending in the longitudinal direction of the first connector body, the first slider has a body part that has a flat plate shape and is slidably placed on an upper surface of the slider holding part, and a biasing force receiving part that is connected to a front end of the body part and enters the biasing member containing part to come into contact with one end of the biasing member, and the locking protrusions are connected to both right and left ends of the body part, and face outer side surfaces of wall members on both sides of the slider holding part.

12. The connector assembly according to claim 11, wherein the first lock device further has a first reinforcement bracket mounted on the connector body, the reinforcement bracket covering at least a part of an outer side of the first slider.

13. The connector assembly according to claim 12, wherein the first reinforcement bracket has a first body part that has a flat plate shape and is placed on an upper surface of the body part of the first slider in such a manner as to be slidable relative to the first body part, right and left front side leg parts that are respectively connected to both right and left ends of the first body part and cover at least a part of outer side surfaces of the locking protrusions, and back side leg parts that are connected to a back end of the first body part and mated with the first mating guide part.

14. The connector assembly according to claim 13, wherein the locking protrusions each include protrusion pieces protruding outward beyond outer side surfaces of the front side leg parts.

15. The connector assembly according to claim 12, wherein first the reinforcement bracket further has right and left connection arm parts having base ends connected to front ends of the front side leg parts, contact arm parts that contact with the second reinforcement bracket are connected to a free end of each connection arm part, and a side guide part which is formed at a position closer to a base end of the connection arm part than to the free end, the side guide part guiding the second mating guide part when the first connector body and the second connector body are mated together.

* * * * *